US011257324B2

(12) United States Patent
Karrbrink et al.

(10) Patent No.: US 11,257,324 B2
(45) Date of Patent: Feb. 22, 2022

(54) SLOT MACHINE GAME WITH BANKING OF PLAYER ERROR

(71) Applicant: Green Jade Games Ltd, Ta' Xbiex (MT)

(72) Inventors: Jesper Karrbrink, Stockholm (SE); Andy Hieke, San Francisco, CA (US); Joe Kisenwether, Sparks, NV (US)

(73) Assignee: Green Jade Games Ltd

( * ) Notice: Subject to any disclaimer, the term of this patent is extended or adjusted under 35 U.S.C. 154(b) by 0 days.

(21) Appl. No.: 16/449,336

(22) Filed: Jun. 21, 2019

(65) Prior Publication Data

US 2020/0402348 A1 Dec. 24, 2020

(51) Int. Cl.
*G07F 17/32* (2006.01)
*G07F 17/34* (2006.01)

(52) U.S. Cl.
CPC ..... *G07F 17/3262* (2013.01); *G07F 17/326* (2013.01); *G07F 17/3213* (2013.01); *G07F 17/3239* (2013.01); *G07F 17/3267* (2013.01); *G07F 17/3295* (2013.01); *G07F 17/34* (2013.01)

(58) Field of Classification Search
None
See application file for complete search history.

(56) References Cited

U.S. PATENT DOCUMENTS

2008/0051190 A1* 2/2008 Okada ..... G07F 17/34 463/20
2011/0053676 A1* 3/2011 Wolf ..... G07F 17/3258 463/20
2015/0170461 A1* 6/2015 Berman ..... G07F 17/3213 463/20
2015/0339881 A1* 11/2015 Falciglia, Sr. ..... G07F 17/34 463/20
2015/0356822 A1* 12/2015 Suda ..... G07F 17/34 463/20
2018/0047253 A1* 2/2018 Vann ..... G07F 17/3262
2019/0005772 A1* 1/2019 Cire ..... G07F 17/3258
2019/0080552 A1* 3/2019 Oyama ..... G07F 17/326
2019/0172304 A1* 6/2019 Koc r ..... G07F 17/3246
2019/0385407 A1* 12/2019 Hiten ..... G07F 17/3258
2020/0027310 A1* 1/2020 Davis ..... G07F 17/3267

* cited by examiner

*Primary Examiner* — Jason T Yen
(74) *Attorney, Agent, or Firm* — Muskin and Farmer LLC

(57) ABSTRACT

A method, system, and computer readable storage to implement an electronic wagering game. The wagering can spin reels of symbols to a random result. A bonus round can be triggered depending on the symbols that result from the spin. If the bonus round is triggered, the player has discretion to take particular actions in the bonus round, and any non-optimal play in the bonus round has an error associated with it which is computed and added to a bonus pool so subsequent players in the bonus round can potentially be awarded the bonus pool.

11 Claims, 12 Drawing Sheets

PRIOR ART

LINE 1

| | | | | |
|---|---|---|---|---|
| X | X | X | X | X |
| | | | | |
| | | | | |

LINE 2

| | | | | |
|---|---|---|---|---|
| | | | | |
| X | X | X | X | X |
| | | | | |

LINE 3

| | | | | |
|---|---|---|---|---|
| | | | | |
| | | | | |
| X | X | X | X | X |

LINE 4

| | | | | |
|---|---|---|---|---|
| X | X | X | | |
| | | | X | X |
| | | | | |

LINE 5

| | | | | |
|---|---|---|---|---|
| | | | | |
| | | | X | X |
| X | X | X | | |

LINE 6

| | | | | |
|---|---|---|---|---|
| X | | | | X |
| | X | | X | |
| | | X | | |

LINE 7

| | | | | |
|---|---|---|---|---|
| | | X | | |
| | X | | X | |
| X | | | | X |

LINE 8

| | | | | |
|---|---|---|---|---|
| | X | X | X | |
| X | | | | X |
| | | | | |

LINE 9

| | | | | |
|---|---|---|---|---|
| | | | | |
| X | | | | X |
| | X | X | X | |

FIGURE 7

CREDITS: 1000
TOTAL BET: 27
BET PER PAYLINE: 3
NUMBER OF PAYLINES: 9
WIN: 0

CREDITS: 1000
TOTAL BET: 27
BET PER PAYLINE: 3
NUMBER OF PAYLINES: 9
WIN: 0

SLOT MACHINE GAME WITH BANKING OF PLAYER ERROR

BACKGROUND OF THE INVENTION

Field of the Invention

The present general inventive concept is directed to a method, apparatus, and computer readable storage medium directed to a slot machine apparatus, method, and computer readable storage which can bank player error.

Description of the Related Art

Slot machine games are a billion dollar industry. They can be played in physical, brick and mortar casinos as well as at online casinos. Slot machine games which incorporate player skill are becoming more popular.

SUMMARY OF THE INVENTION

It is an aspect of the present invention to provide an improved slot machine game.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 7 is a drawing showing sample paylines for a slot machine game, according to an embodiment;

DESCRIPTION OF THE PREFERRED EMBODIMENTS

Figure 1:
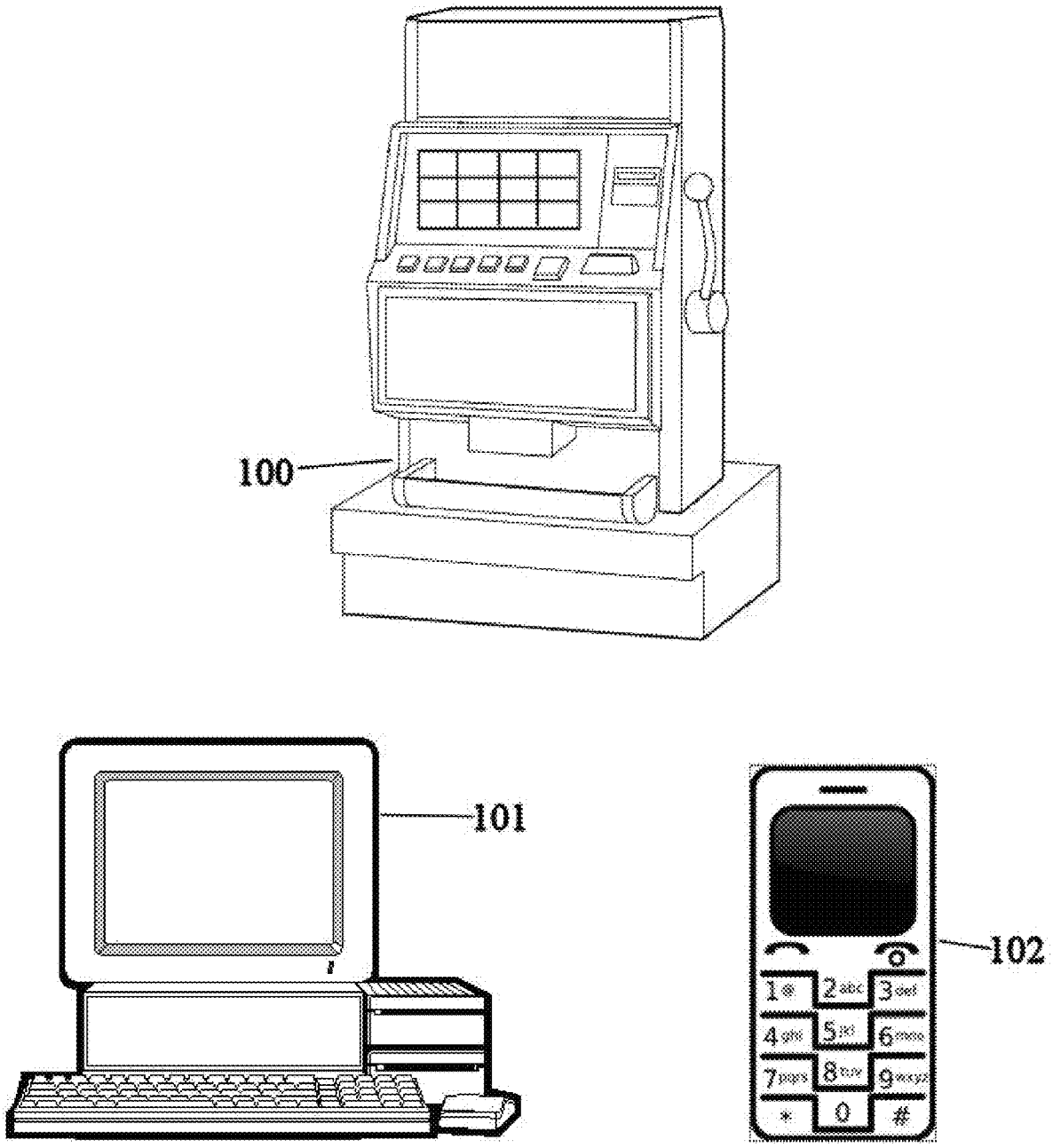
FIG. 1 is an example of different systems in which the methods described herein can be played (applied), according to an embodiment.

Reference will now be made in detail to the presently preferred embodiments of the invention, examples of which are illustrated in the accompanying drawings, wherein like reference numerals refer to like elements throughout.

The general inventive concept relates to a slot machine type game which enables the player to place a wager in credits, spin reels to a random result, and then potentially win credits based on what combination results after the reels stop spinning. A unique game mechanic is described which triggers a bonus round upon the presence of a predetermined number of adjacent bonus symbols after a spin. Once the bonus round is triggered, the player has the ability to place "charges", that is marks (e.g., indicia) on any symbol(s) on the slot machine grid the player chooses. Once the player is done placing the charges, the player can press a "proceed" button which will explode the charges thereby removing the symbols that were present where the charges were placed resulting in an empty space in the slot machine grid. The symbol(s) over the empty space will now "fall" down and fill all empty spaces until all empty spaces (that resulted from a placed charge) are filled. The number of horizontally adjacent bonus symbols is now counted and the player is given an award based on a number of horizontally adjacent bonus symbols that are present in the very same row (the more bonus symbols in the same row, the higher the award). Thus, the player's goal is to place the charges such that the player will maximize the number of bonus symbols that are horizontally adjacent (adjacent in the same row).

Another inventive concept is the ability of the game to bank player error so subsequent players have the ability to earn the error that was lost by previous players. A bonus round can be triggered (infrequently, maybe 1% to 20% (or more) or all players of the main slot machine game), which incorporates skill decisions by the player. If the player makes the optimal decisions then the player can be rewarded by earning error from previous players. If player's make error(s) (play sub-optimally) then they may earn a lesser award than if they played optimally but their error (actually a numerical computation representing the value of their error) can be banked in a bonus pool so subsequent plays of the game (by the same or different players) can earn the contents of the bonus pool by playing optimally. Note that the bonus pool is shared by all players of the game, so that players would contribute to the same pool bonus and gain awards from the same bonus pool.

FIG. 1 is an example of different systems in which the methods described herein can be played (applied), according to an embodiment.

The game described herein can be played by players on a typical electronic gaming machine (e.g., slot machine), a personal computer (or laptop) 101, or a cell (mobile) phone 102. Each of these devices would be connected to a network which would be connected to a server 500. The connection can be via a physical LAN, wireless connection (e.g., WIFI, Bluetooth, etc.) simple cables, etc.

Figure 2:
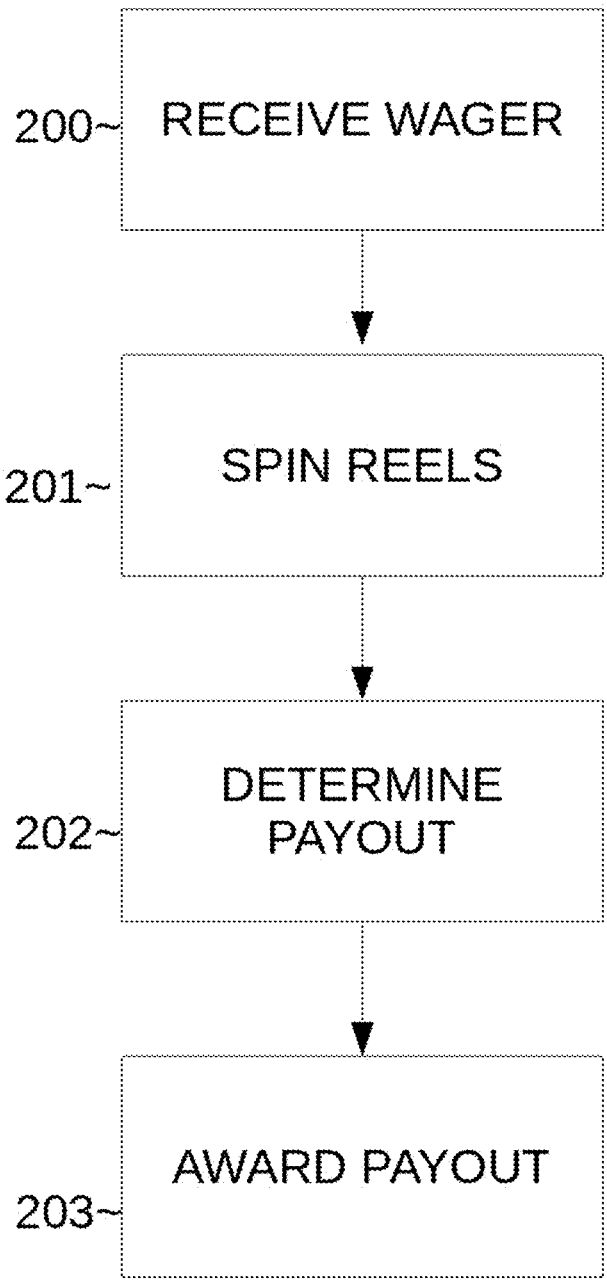
FIG. 2 is a flowchart illustrating an operation of a prior art slot machine, according to an embodiment.

FIG. 2 is a flowchart illustrating an operation of a prior art slot machine, according to an embodiment.

FIG. 2 is a flowchart illustrating a method of how a prior art slot machine operates. There are many types of slot machine games (e.g., five reel, three reel, one reel, etc.) and they all generally operate in the same manner.

Before the player can start making wagers (and playing), the player must fund the machine with real money (e.g., cash) or non-cash value credits. For example, the player can deposit cash (e.g., a $10 bill) which would credit the machine/account with $10 in credits (if credits are $1 per credit then this would translate to 10 credits). The machine/account can also be funded by other mechanisms as well, such as an electronic funds transfer, credit card payment, etc. If the game is being played online at an online casino, the player's account can be funded using an electronic payment mechanism (e.g., credit card payment, payment in bitcoin or other crypt-coin, etc.)

In operation 200, the slot machine game receives a wager from the player. Each machine keeps a balance of credits which are used to make wagers. Each spin (play) of the game costs a particular amount of credits (e.g., 1 credit, 10 credits, etc.) The player would indicate that he/she has placed his wager by pressing a button on the game (e.g. virtual or physical) which would cause the reels to spin (in operation 201). The player may also choose how many paylines to play (more paylines would typically cost more credits). A payline is a set of locations on each reel that, when combined, are compared to a paytable to determine whether a spin is a winning spin or not and if it is a winning spin what the payout would be. The wager is received by deducting the wager amount (typically in credits) from a credit meter (which displays the entire amount of credits the machine currently possesses).

From operation 200, the method proceeds to operation 201, which spins the reels. In a physical slot machine game, the reels will be physical reels which physically spin, while in a virtual slot machine the reels do not physically exist and are displayed on an electronic output device (e.g., LCD) and are spun using computer animation. Each reel will stop on a random symbol selected by a random number generator. Each reel has a set of symbols according to a reel mapping which is typically a linear set of symbols that is "wrapped" around the reel. The reel mapping is typically predetermined for each game. In an embodiment all reels can have the same mapping but in another embodiment reels can have different mappings.

From operation 201, the method proceeds to operation 202, which determines a payout based on the symbols displayed on the slot machine. One or more paylines will be active based upon the game rules and what paylines the player chose to bet in operation 200. For all of the active paylines, a respective payline award is determined based on comparing the symbols that fall into each payline to a paytable. All of the respective payline awards are added together to determine the payout for the spin.

From operation 202, the method proceeds to operation 203, which awards the payout to the player. This is typically accomplished by increasing the credit meter by the amount of the payout. If the payout is zero, then the spin is not a winning spin (it is a losing spin) and there is no payout (this can also be considered a payout of zero).

From operation 203, the player can then play a new game as the method can return to operation 200. At any time the player can cash out the credits on the credit meter by pressing a button and the player could receive all of the machine's credits (e.g., as a cashless voucher, in coins/currency, as an electronic transfer to the player's account, etc.)

One of the inventive concepts herein is a bonus mechanic which adds a bonus round to the gameplay of a slot machine. The bonus round incorporates skill of the player in that the player makes choices on where to place charges. Optimal placement of the charges will result in a higher expected award than sub-optimal placement of the charges.

Figure 3:
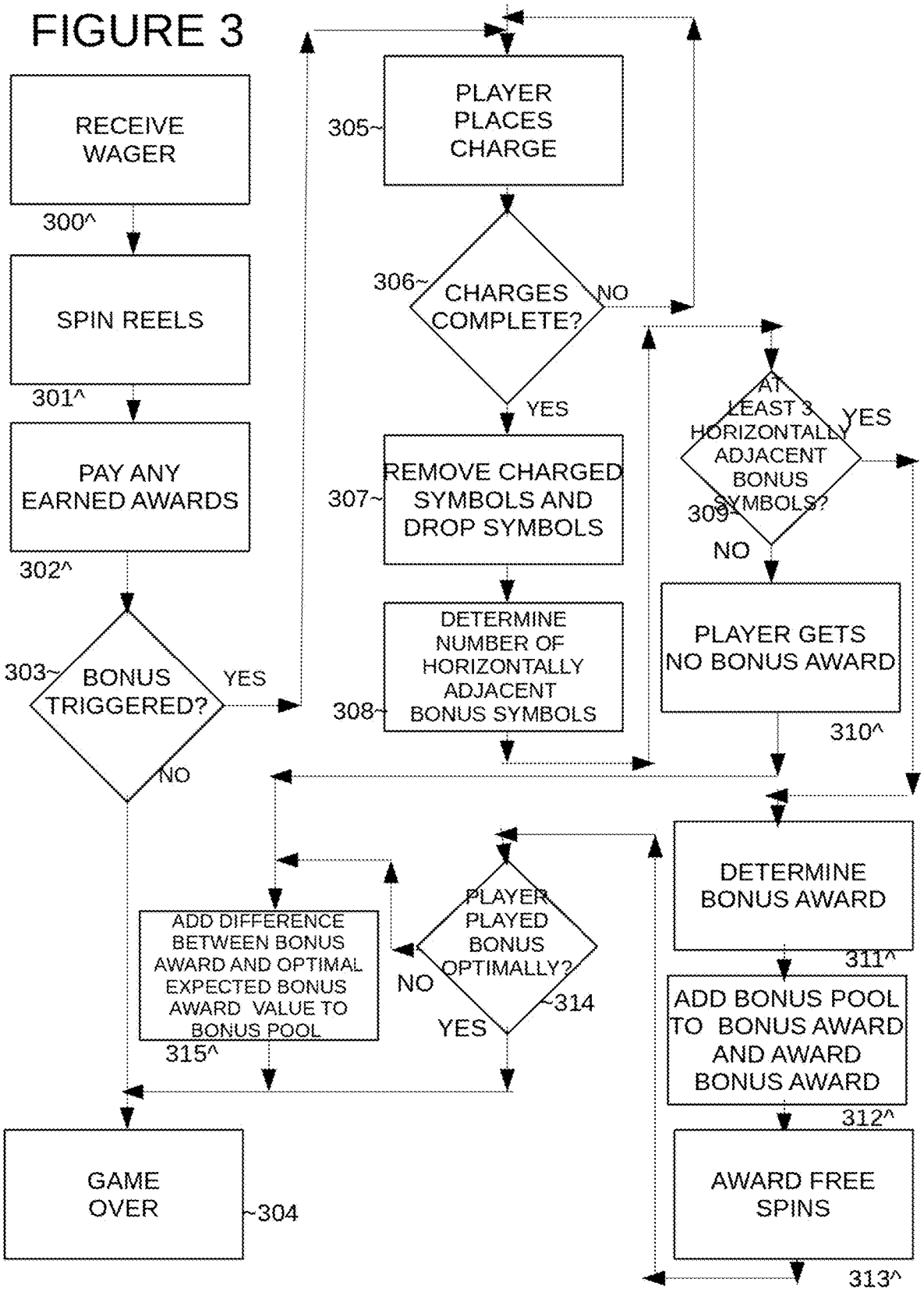
FIG. 3 is a flowchart illustrating an exemplary method of implementing a slot machine with a symbol destroy bonus, according to an embodiment.

FIG. 3 is a flowchart illustrating an exemplary method of implementing a slot machine with a symbol destroy bonus, according to an embodiment.

The method can begin with operation 300, wherein the player places a wager (the machine receives the wager). This can be done as known in the art, wherein the player funds the game with actual cash (e.g., credit card payment, cash deposit, etc.) and then the player indicates to the machine how many credits the player wishes to bet (e.g., how many paylines to bet on and how much the wager is per payline, etc.)

From operation 300, the method proceeds to operation 301, which spins the reels. The player typically presses (e.g., physically presses, touches (on a touch-screen), clicks (with a mouse), etc.) a "spin" button on the game which initiates spinning of all of the reels of the slot game. A random number generator (implemented in hardware and/or software) will determine where the reels will stop spinning and all of the reels will stop spinning at a random position, forming a final combination of symbols.

From operation 301, the method proceeds to operation 302, which pays any earned awards to the player based on the final combination of symbols from operation 301. A paytable is used to determine if the player is entitled to an award, and how much. The symbols on each payline will be compared to a paytable to determine if each particular payline forms a winning combination, and if so, the award for that particular payline is computed by multiplying the wager for that particular payline times the payout for the winning combination that appears on that particular payline. All of the awards (if any) that are earned for each payline are added up and paid to the player (by increasing the credit meter by the total award amount).

Figure 4:
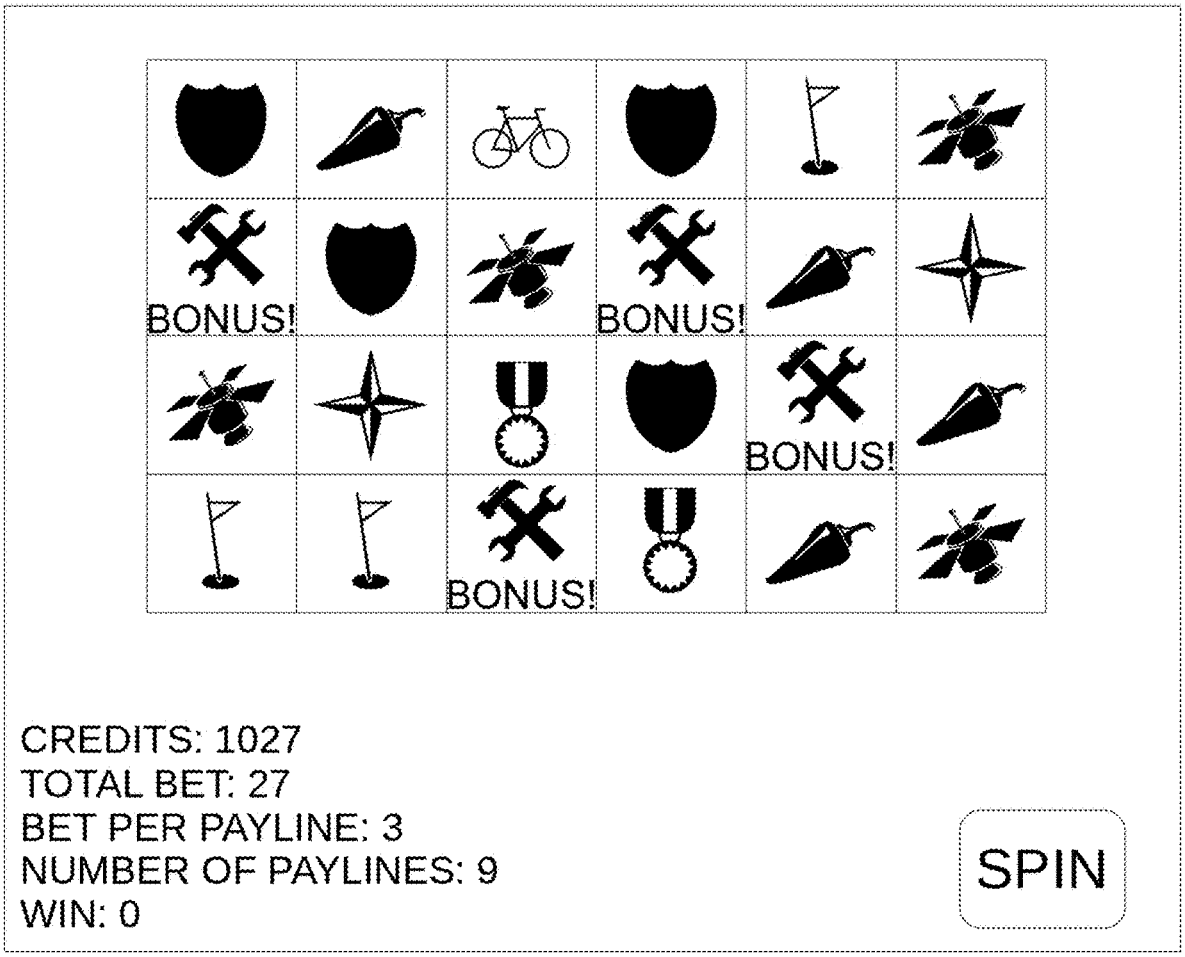
FIG. 4 is a drawing of a slot machine game grid, according to an embodiment.
Figure 10:
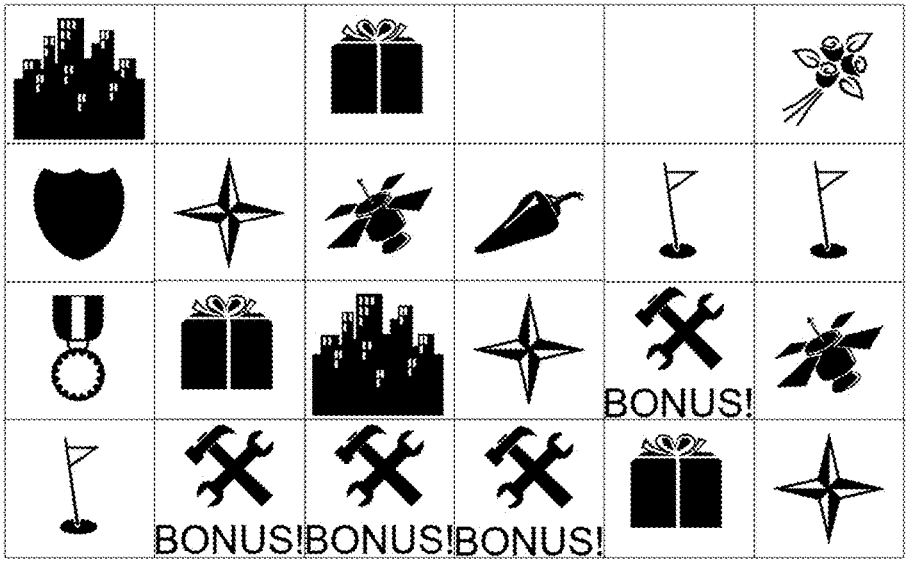
FIG. 10 is a drawing showing the symbols in each column dropped down to fill in any empty spaces, according to an embodiment.

From operation 302, the method proceeds to operation 303 which determines whether the bonus round is triggered. The bonus round is triggered if a predetermined combination of symbols occurs on the reels. In one embodiment, the bonus round would be triggered if at least three bonus symbols (or in another embodiment at least two bonus symbols) are in adjacent reels (adjacent reels means that at least three bonus symbols are in adjacent reels). For example, if the reels are numbered left to right from 1 to 6, and there is a bonus symbol in reels 2, 3, and 4 then this would trigger the bonus round because there are at least three bonus symbols in adjacent reels. If there are bonus symbols in only reels 2, 3, and 5, then this would not trigger the bonus round because the bonus symbols are not in adjacent reels (reel 4 which is in-between the bonus symbols) does not have a bonus symbol. Note that it typically would not matter which row (e.g., vertical height) in the reel the bonus symbol is located in. If the predetermined combination required to trigger the bonus round (in this example, at least three bonus symbols that are in adjacent reels) does not appear, then the bonus round would not be triggered. Of course, any other combination/pattern can be used to determine whether the bonus round is triggered or not. To determine whether the bonus round is triggered, the number of adjacent bonus symbols can be counted. For example, FIG. 4 shows three adjacent bonus symbols. To determine the payout on the bonus award (in operation 308), the number of horizontally adjacent bonus symbols is determined. Horizontally adjacent bonus symbols are bonus symbols in adjacent (vertical) reels but also in the same row (for example, FIG. 10 shows three horizontally adjacent bonus symbols).

If in operation 303, the bonus round is not triggered, then the method proceeds to operation 304, wherein the game is over. Of course, the player can play a new game by pressing a particular button and return to operation 300.

If in operation 303, the bonus round is triggered, then the method proceeds to operation 305 wherein the player places a charge. A charge is an icon which indicates that the symbol will be destroyed. The player can select any of the symbols on the grid (e.g., by using a mouse, touching with his/her finger, etc.) and pressing/clicking a button to place a charge there. The player's goal in the bonus round is for the player to place charges in the optimal locations so that the bonus symbols all end up lining up horizontally (all in the same row).

From operation 305, the method proceeds to operation 306, which determines whether the charges are all placed. The player can use a graphical user interface (GUI) to indicate his/her preferences to the system. The player can return to operation 305 and keep placing more charges as the player desires. The player can also remove a charge the player has already places as well if the player has changed his/her mind.

In operation 306, if the player has completed placing all charges then the player can indicate this to the GUI and the method will proceed to operation 307 which will "explode" all of the charges.

In operation 307, all of the symbols that have charges placed on them are removed, leaving a "blank" or open symbol. An audio sound (such as an explosion) can be played to increase the realism of the effect as well. All of the columns with empty symbols are then shifted downwards until all of the empty symbols are filled in with symbols from above. This may leave an empty symbol(s) on the top of each column where a charge(s) was placed in that column. This new set of symbols, with all of the exploded symbols removed, can be referred to as a modified position (see FIG. 10). When all of the charges have exploded, then the method proceeds to operation 308.

In operation 308, it is determined the number of horizontally adjacent bonus symbols are present. Horizontally adjacent means the symbols are all on adjacent reels (columns) and in the same row. In other words, X (a number) horizontally adjacent bonus symbols means that all X of the horizontally adjacent bonus symbols are on adjacent reels (columns) and a horizontal line could be drawn though all X of the horizontally adjacent bonus symbols with no non-bonus symbols coming between the horizontally adjacent bonus symbols. In other words, horizontally adjacent means "in a row" (horizontally).). The player's goal is to place the charges (in operation 305) to get the most horizontally adjacent bonus symbols the player could achieve. Not all symbols are bonus symbols, for example in the game exemplified herein only the symbols that say "bonus!" are bonus symbols.

From operation 308, the method proceeds to operation 309, which determines whether the player has achieved at least three (or other number depending on the predefined rules) horizontally adjacent bonus symbols. If the player has not achieved at least three horizontally adjacent bonus symbols, then the method proceeds to operation 310.

Note that it may be possible (by coincidence) that all of the adjacent bonus symbols are already (without charges being needed) horizontally adjacent (e.g., their stopping position in operation 301 resulted in the bonus symbols already horizontally aligned (in a same row)). If this is the case, the player would not need to place any charge at all since all of the bonus symbols are already in their optimal position. As such, while the player can place charges in this situation, the player would not need to do so in order to have played optimally.

In operation 310, the player gets no bonus award. The player has not achieved the minimum result required (at least three horizontally adjacent bonus symbols) to earn a bonus award (and no free spins in operation 313). So the player gets no bonus award and the method proceeds to operation 315.

In operation 309, if the player has achieved at least three horizontally adjacent bonus symbols, then the method proceeds to operation 311.

In operation 311, a bonus award is determined based on the number of horizontally adjacent bonus symbols the player which are present in the grid (after operation 308). The bonus symbols (in order to be counted) must be an adjacent reels (no reels in between without a bonus symbol) and must all be on the same row. Different award algorithms could be applied depending on how many horizontally adjacent bonus symbols are present. For example, Table I below illustrates an example set of award algorithms (bonus award algorithms) for different numbers of horizontally adjacent bonus symbols Random (x-y) means a random number in the range of x-y (including x and y) is determined. Note that x and y should not be equal and should preferably have at least a minimum number of integers between them (e.g., 2, 5, 10, 20, or any other number). Note that in an embodiment, the result of the award algorithm can be multiplied by the amount of the wager, and the expected value would reflect the award algorithm multiplied by the amount of the wager.

TABLE I

| # horizontally adjacent bonus symbols | award algorithm | expected value |
|---|---|---|
| 3 | random (5-25) | 15 |
| 4 | random (10-40) | 25 |
| 5 | random (20-50) | 35 |
| 6 | random (40-80) | 60 |

As can be seen by the award algorithms in Table I, it would be in the players interest to place the charges so that the result is the maximum possible number of horizontally adjacent bonus symbols are present.

Based on the number of horizontally adjacent bonus symbols that were determined in operation 308, the respective algorithm (for that number) is called (using for example Table I). The result of the algorithm is the bonus award (which can be awarded to the player in operation 312 although the bonus award may be increased depending on how the player played).

For example, if in operation 308, it was determined that the player achieved four horizontally adjacent bonus symbols, then the algorithm from Table I would be utilized which picks a random number between 10 (inclusive) and 40 (inclusive). Assume this number is 33. Then 33 would be the bonus award which would be awarded to the player.

Note that in an embodiment, the result of the algorithm utilized is then multiplied by the wager the player made in order to determine the bonus award. For example, if the player wagered 4 credits per payline, and the bonus algorithm results in an award of 3, then the bonus award (for example determined in operation 311) is 3*4=12 credits.

From operation 311, the method proceeds to operation 312, which adds the entire bonus pool to the bonus award determined in operation 311. In this manner, the player is getting the value of the error(s) that previous player(s) made when playing the bonus game/round. If the bonus pool is zero (empty) then nothing is added to the bonus award. Note that in one embodiment, 100% (the entire) bonus pool will be awarded to the player (added to the bonus award determined in operation 311) and the bonus pool being reset to zero. In another embodiment, a percentage (e.g., 50%) of the bonus pool is awarded to the player (and the bonus pool is reduced by 50%). In another embodiment, if the amount of the bonus pool exceeds a predetermined amount (e.g., $100) then a less than whole portion (e.g., 50%) of the bonus pool is awarded to the player (with the remaining portion (e.g., 50%) remaining in the bonus pool) but if the bonus pool does not exceed the predetermined amount then 100% of the bonus pool is awarded to the player (with the bonus pool being reset to zero). Note that the award to the player from the bonus pool in operation 312 is typically not considered when computing the error in operation 315 (in other words, in operation 315, the error is computed as the optimal expected bonus award value minus the bonus award determined in operation 311 using the respective algorithm but not including any award from the bonus pool from operation 312).

In operation 312, the bonus award (determined in operation 311) is awarded to the player (e.g., added to the player's credit meter) along with the amount of the bonus pool that is also awarded to the player (typically the amount of the bonus pool that is also awarded to the player is subtracted from the bonus pool). So the player really get two awards, the bonus award plus a portion (or entirety) of the bonus pool, although this could be zero if the bonus pool is zero. Typically, the entire amount awarded to the player in this operation (bonus award plus bonus award taken from the bonus pool) is displayed to the player as a lump sum. Typically, the player would not be informed if any part of the bonus award came from the bonus pool and how much was from the bonus pool. Typically, all awards made to the player are done by increasing the credit meter by the awarded amount.

In an embodiment, the player can earn free spins so long as the player has achieved at least three (or other amount) of horizontally adjacent bonus symbols (determined in operation 309). Thus from operation 312, the method can proceed to operation 313, which awards a number (predetermined number or a random number) of free spins (e.g., 1 to 10 or more). The payouts on these free spins are awarded immediately and are not part of any bonus award or bonus computation. Operation 313 can be optional depending upon the game design (in other words, the game does not have to award free spins).

From operation 313 (or operation 312 if no free spins are awarded), the method proceeds to operation 314.

In operation 314, it is determined whether the player played the bonus round optimally. The optimal play of the bonus round would result in the most possible bonus symbols from operation 301 (after the reels stop spinning) being horizontally adjacent (all in the same row and touching each other). In an embodiment, the optimal (most possible) number of horizontally adjacent bonus symbols would be equal to the number of adjacent bonus symbols that triggered the bonus round in operation 303. If the player's placement of the charges (in operation 305) results in the optimal number of bonus symbols being horizontally adjacent (all in the same row and touching each other) then the player has played optimally, then the method proceeds to operation 304 in which the game ends (with no contribution being made to the bonus pool based on the player's error since there is no player error). If the player's placement of the charges (in operation 305) results in less than the greatest number of bonus symbols (sub-optimal play) that are horizontally adjacent (all in the same row and touching each other) then the method proceeds to operation 315. Of course, it is the player's goal to play optimally as this will maximize the player's expected award. Note that the system will assume the player's hammer is fully charged when determining whether the player played the bonus round optimally, even if the player's hammer was not fully charged. For example, the hammer can have a maximum of five charges but it may currently have only one charge and if the optimal play requires two charges then the player will not be able to play optimally.

In operation 315, the player has not played the bonus round optimally and hence his/her error will be added to the bonus pool. The error is the difference between the bonus award (determined in operation 311) and the optimal expected bonus award value. The optimal expected bonus award value is computed by determining how many bonus symbols would have been horizontally adjacent (all in the same row and touching each other) if the player had played optimally (the optimal number of bonus symbols) and then determining what the expected value of the award algorithm for the optimal number of bonus symbols would be (see Table I). Typically, the optimal expected bonus award value minus the bonus award (from operation 311) is considered the error and will be a positive number. The error is a measure of the cost to the player of his/her error, in other words, the mathematical value of how much the player's mistake(s) in playing the bonus round cost him. The error is added to the current value of the bonus pool.

For example, if in the bonus round the player could have placed the charges to result in six horizontally adjacent bonus symbols but instead, due to the player's mistakes ends up with only four horizontally adjacent bonus symbols. From Table I, the award algorithm is random (10-40) and so in this example we will assume the bonus award is determined to be 18 credits (using a random number generator). The optimal expected bonus award value for six horizontally adjacent bonus symbols would be (from Table I) 60 credits. So the error would be 60 minus 18 equals 42 credits. Thus, the current value of the bonus pool would be increased by 42 credits. Note that the error could be different even for the same set of circumstances because the bonus award involves a random determination. Note that the error can be computed considering the wager amount. For example, if the player was wagering one credit in this example and the error was determined to be 18 credits, then if the player was wagering two credits in this example then the bonus award of 18 (for one credit) is multiplied by 2 (to get the bonus award for two wagered credits)=36 and the optimal expected bonus award value is 60 credits multiplied by two is 120 credits to the error for wagering two credits in this example would be 120 minus 36=84 (which is also 42 credits multiplied by 2).

Note that in operation 319, typically the entire error of the player is contributed into the bonus pool. However, in another embodiment, a percentage of the error of the player is kept by the casino (house) before the error is put into the bonus pool. For example, if the error is 10 credits and the casino (house) takes 10% of all errors, then 9 credits would be added to the bonus pool and the casino (house) would keep 1 credit (10% of the error). In order for the house/casino to keep this 1 credit the system does not actually need to do anything as the house/casino retains this 1 credit (e.g., 10%) by virtue of not paying it either to the player or the bonus pool.

Note that if operation 315 is being performed directly after operation 310 (the player has not achieved at least three horizontally adjacent bonus symbols) then operation 315 is still performed the same way considering that the bonus award is zero (since the player got 0 for the bonus award in this case).

From both operation 3153, the method proceeds to operation 304, wherein the game ends.

Thus, the method set forth in FIG. 3 (and described herein) results in a system which enables a player to utilize skill in a bonus round which would affect the player's award (the better the player's skill, typically the higher the bonus award). However, for players who play sub-optimally and do not earn as high as an award as they could have, the error is then put into a pool so it can be returned to other players (it is also possible for the same player to get back that player's error from his/her earlier play of the game if the player plays optimally and earns the value of the bonus pool before any other player does).

Note the game is played online by many players (e.g., 2-1,000 or more) so that the overall system results in the errors made by players being returned to the players of the game. In this way, the online casino hosting the game cannot be accused of taking advantage of non-skilled players by keeping all of their error. An online casino can host many such players and utilize a computer communications network to enable the bonus pool to be accessible to all players. Note that the game/method can also be applied to physical electronic gaming machines located in casinos, in which the bonus pool could be utilized by only those electronic gaming machines located at a certain casino or all casinos which are part of an entire casino group. In other words, all electronic gaming machines implementing the method at casino A may utilize a different bonus pool than all electronic gaming machines implementing the method at casino B.

Note that when the game is first initiated (the first play is enabled on a casino (whether physical or online), the bonus pool would typically start with a value of zero. However, the bonus pool would then continuously vary according to the course of events and how players play the game, as described herein.

Another example of the use of the bonus pool is presented in Table II. The left column is the game # which are played in order (not necessarily by the same player). "Optimal #BS" stands for the optimal number of bonus symbols, "actual #BS" stands for actual number of bonus symbols meaning how many bonus symbols the player actually obtained in the bonus round after placing and exploding the charges.

TABLE II

| Game # | Bonus Pool | Optimal # BS | Actual # BS | Bonus Award | error |
|---|---|---|---|---|---|
| 1 | 0 | 3 | 3 | 11 | 0 |
| 2 | 0 | 4 | 3 | 20 | 5 |
| 3 | 5 | 5 | 4 | 10 | 25 |
| 4 | 30 | 3 | 3 | 17 + 30 = 47 | 0 |
| 5 | 0 | 6 | 6 | 70 | 0 |

In this example set of games from Table II, the first game the player plays optimally and earns a bonus award of 11 (see Table I, # horizontally adjacent bonus symbols=3). Since the player played optimally, there is no error (error equals zero), thus the bonus pool remains at zero. In game #2, the next player triggers the bonus round with an optimal number of bonus symbols of 4 but only achieves 3 horizontally adjacent bonus symbols after placing the charges. The player's bonus award for 3 horizontally adjacent bonus symbols is determined to be 20 (see Table I, the award algorithm for 3 horizontally adjacent bonus symbols is random (5-25)) which in this example is randomly determined to be 20. The expected value for the optimal number of bonus symbols (4 bonus symbols) is 25, so the error is 25-20 equals 5. Five is added to the bonus pool. In Game 3, the next player also does not play optimally and achieves only 4 horizontally adjacent bonus symbols even though the player could have obtained 5 horizontally adjacent bonus symbols had the player played optimally. The player's bonus award is randomly determined to be 10 (the award algorithm for 4 bonus symbols is random (10-40) and the expected value for 5 horizontally adjacent bonus symbols is 35. 35 minus 10 equals 25, which is the error and which is added to the bonus pool meaning the bonus pool now has 30 credits. The next player to play plays optimally (achieves the optimal number of horizontally adjacent bonus symbols of 3) and the bonus award is randomly determined to be 17 (using an award algorithm of random (5-25)). Since this player also played optimally, his/her bonus award is increased by the entire amount in the bonus pool which is 30 meaning the total bonus award is 47, and the bonus pool is now reset to zero. In the next game (game 5), the subsequent player plays perfectly (optimally) and achieves 6 horizontally adjacent bonus symbols which is the optimal number of bonus symbols and wins a bonus award of 70 (from the award algorithm for 6 horizontally adjacent bonus symbols which is random (40-80). Since the bonus pool is zero (empty) this player does not get any additional bonus and his/her bonus award is 70. Note that all the players in this example are different players, although it is possible two (or more) of the games listed can be played by the same player. The system treats every player equally and it does not matter if a same player made an error previously and contributed to the bonus round. If only a single player is playing, then the player will play all of the games in sequence, however more common would be the case where there are a lot of players playing the game simultaneously and hence players who play optimally would also get the error contributed to the bonus pool by other players. Hence it would be unlikely for a player to win back his/her own actual error (the actual credits) which was put into the bonus pool by the same player playing optimally in a later game.

Table III below is an example of another set of award algorithms that can be used, this set includes free spins (which are optional and can also be awarded based on the game designers' preferences). "HABS" stands for horizontally adjacent bonus symbols. Of course, any other set of award algorithms can be devised (some may award free spins some may not) and the game designers can always devise a set of award algorithms to suit their preferences (e.g., desired house advantage, etc.)

TABLE III

| # HABS algorithm | award algorithm | expected value | free spins award |
|---|---|---|---|
| 3 | random (2-40) | 21 | random (4-20) |
| 4 | random (5-75) | 40 | random (9-50) |

TABLE III-continued

| # HABS algorithm | award algorithm | expected value | free spins award |
|---|---|---|---|
| 5 | random (25-150) | 87.5 | random (30-75) |
| 6 | random (80-10000) | 5040 | random (65-120) |

Note in the example in Table III, each bonus award also awards a random amount of free spins. For example, if the player achieves four horizontally adjacent bonus symbols then the bonus award awarded to the player (not including any additional amount that may be awarded from the bonus pool) would be a random number between 5 and 75, and the player would also be awarded a random number of free spins between 9 (inclusive) and 50 (inclusive). While typically the error is computed just from the result of the award algorithm subtracted from the optimal expected bonus award value (without considering free spins that were awarded), in another embodiment the value of the free spins can also be incorporated into the computation as well. For example, the error can be computed as (optimal expected bonus award value−result of award algorithm for achieved number of horizontally adjacent bonus symbols)+(optimal expected number of free spins−result of free spin award algorithm for achieved number of horizontally adjacent bonus symbols) *expected value of a free spin. The optimal expected number of free spins is the expected number of free spins if the player had achieved the optimal number of horizontally adjacent bonus symbols, and the result of free spin award algorithm for achieved number of horizontally adjacent bonus symbols is the actual number of free spins the player was awarded which uses the respective free spins award algorithm for the number of horizontally adjacent bonus symbols the player actually achieved in the bonus round.

Note that in an embodiment, a player can play the slot game with different denominations (e.g., $0.01 per line, $0.05 per line, $0.10 per line, etc.) and a different bonus pool can be maintained for each different denomination that is played. For example, there can be a specific bonus pool for players playing 1 cent per line, another specific bonus pool for players playing 5 cents per line, etc. Note that typically all bonus awards determined from the bonus algorithms (e.g., those listed in Tables I and III) are multiplied by the wager amount (e.g., amount bet per line which is typically the same for all lines). Note that in an embodiment, the error computed can be multiplied by the wager amount (e., amount bet per line which is typically the same for all lines). The error is an estimation of how much in credits the player's mistakes actually cost the player, which is then "given" to other players by virtue of that error being put into the bonus pool. In another embodiment, the same bonus pool can be shared among different players even though those different players are wagering using different denominations/amounts.

FIG. 4 is a drawing of a slot machine game grid, according to an embodiment.

This example game uses six reels, although any other number of reels can be used (e.g., 3-7 or more). This is also a 6×4 grid although other dimensions can be used as well. Each of the six reels comprises n consecutive symbols to form a concentric reel wherein n can be any number (e., from 8 to 64 or more). A paytable can be utilized (such as that illustrated in Table IV), to determine winning awards. Of course the payouts shown in Table IV is just an example of a paytable, and it can be appreciated that any other paytable can be used as well.

TABLE IV

| Symbol | 6 symbols | 5 symbols | 4 symbols | 3 symbols | 2 symbols |
|---|---|---|---|---|---|
| Shield | 1000:1 | 500:1 | 250:1 | 100:1 | 10:1 |
| Pepper | 500:1 | 200:1 | 75:1 | 5:1 | 0 |
| Flag | 100:1 | 20:1 | 10:1 | 0 | 0 |
| Bicycle | 75:1 | 15:1 | 8:1 | 0 | 0 |
| Medal | 80:1 | 30:1 | 5:1 | 0 | 0 |
| Present | 50:1 | 15:1 | 2:1 | 0 | 0 |
| flower | 40:1 | 10:1 | 1:1 | 0 | 0 |
| Satellite | 25:1 | 5:1 | 1:1 | 0 | 0 |
| Star | 20:1 | 5:1 | 1:1 | 0 | 0 |
| City | 5:1 | 1:1 | 0 | 0 | 0 |

Typically, the payouts are based on probability of achieving each combination, such that the lesser the probability of achieving a particular combination, the greater the award will be. Combinations not listed have an award of 0. Note that winning combinations are determined from left to right on each payline. for example, for a winning combination to appear, the symbols in the winning combination have to appear from left to right on the payline. For example, if the slot machine game results in a payline (from left to right) having the symbols: star/city/star/star/star/star, this would not be a winning combination because there is only one consecutive "star" symbol from left to right which does not result in an award. As another example, if a particular payline has the symbols (from left to right): shield/shield/shield/city/shield/shield, this would result in award of 100:1 because there are only three consecutive shield symbols from left to right before a non-shield symbol is present (meaning the last two shield symbols do not count). Note that in FIG. 4 there are 3 adjacent bonus symbols (but zero horizontally adjacent bonus symbols). Note that there are not 4 adjacent bonus symbols because the bonus symbol in the first column (reel) is not adjacent to the bonus symbol in the third column (reel).

Figure 5:
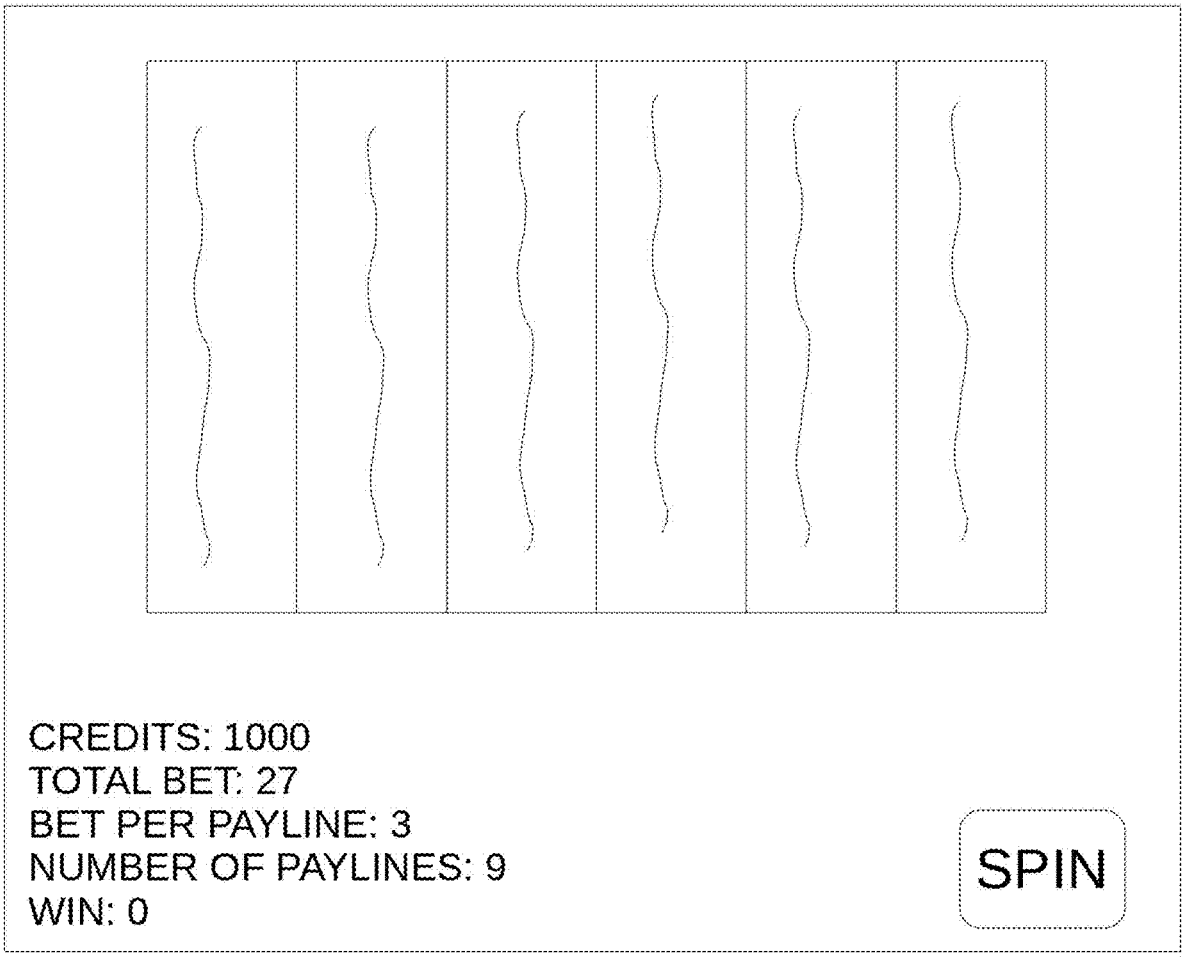
FIG. 5 is a drawing showing the slot machine game reels spinning, according to an embodiment.

FIG. 5 is a drawing showing the slot machine game reels spinning, according to an embodiment.

After the player has pressed the "spin" button, the reels spin and will stop at random positions after a short amount of spinning time (e.g., one second or other amount).

Figure 6:
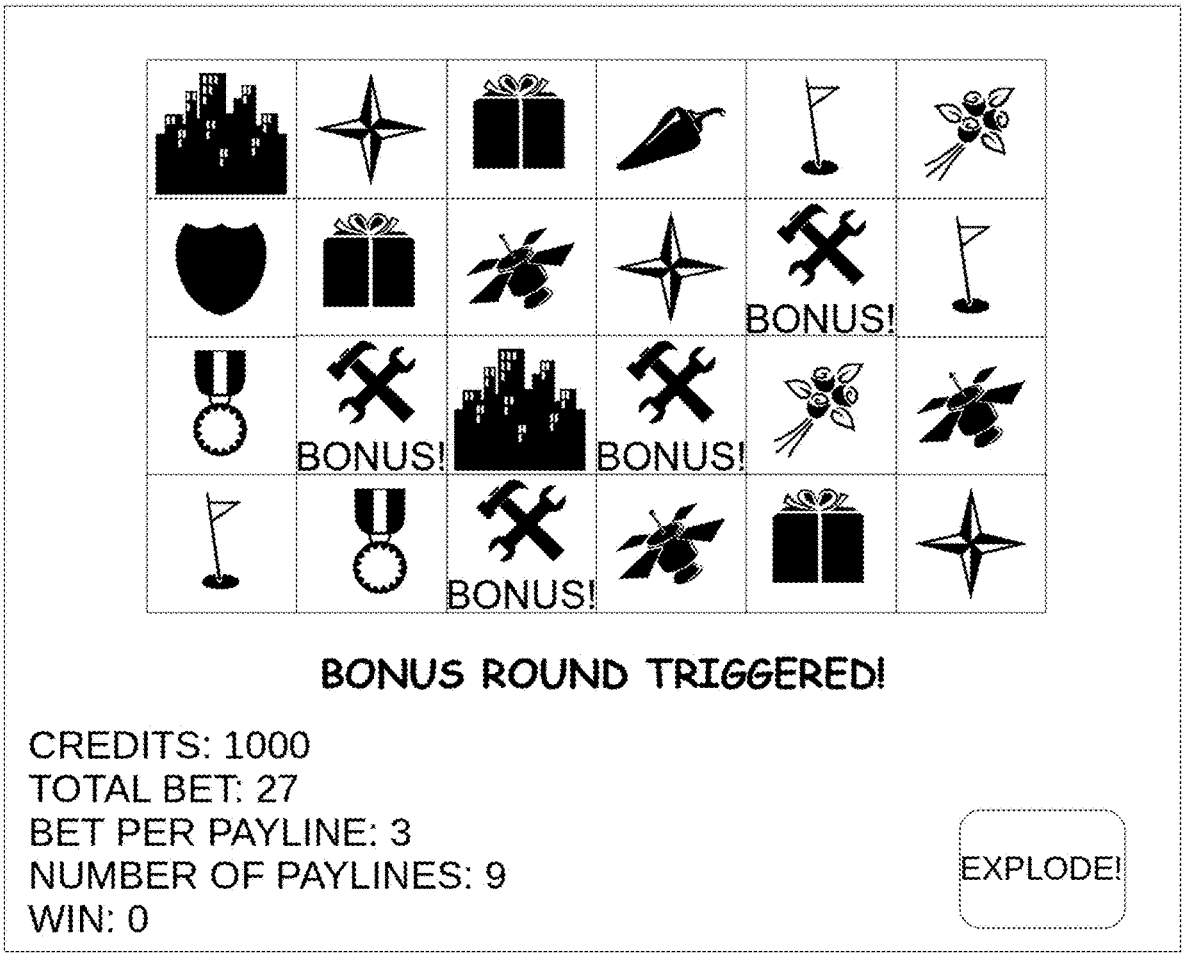
FIG. 6 is a drawing showing an example final result of the slot machine grid after the spin, according to an embodiment.

FIG. 6 is a drawing showing an example final result of the slot machine grid after the spin, according to an embodiment.

The reels have stopped on random positions. In this final position, no awards are won (there are no winning combinations on all of the paylines) but there are four bonus symbols in adjacent reels which will trigger the bonus round (in an embodiment, at least three bonus symbols in adjacent reels will trigger the bonus round).

FIG. 7 is a drawing showing sample paylines for a slot machine game, according to an embodiment.

Shown is an exemplary set of paylines, which are the symbols from left to right which are evaluated to determine if there is a winning combination. Of course, other paylines can be used and any number of paylines can also be used (from 1 to the number of possible combinations which can be formed from the symbols from left to right). Typically, the player can choose how much to bet on each payline and how many (and which ones) paylines the player is betting on. If there are 9 paylines and the player bets 1 credit on each payline, then the cost (wager) for each spin is 9 credits. If there are 9 paylines and the player bets 5 credits on each payline, then the player is wagering 45 credits per spin. The wager per payline is typically multiplied by the payout for each winning combination on the paytable.

Figure 8:
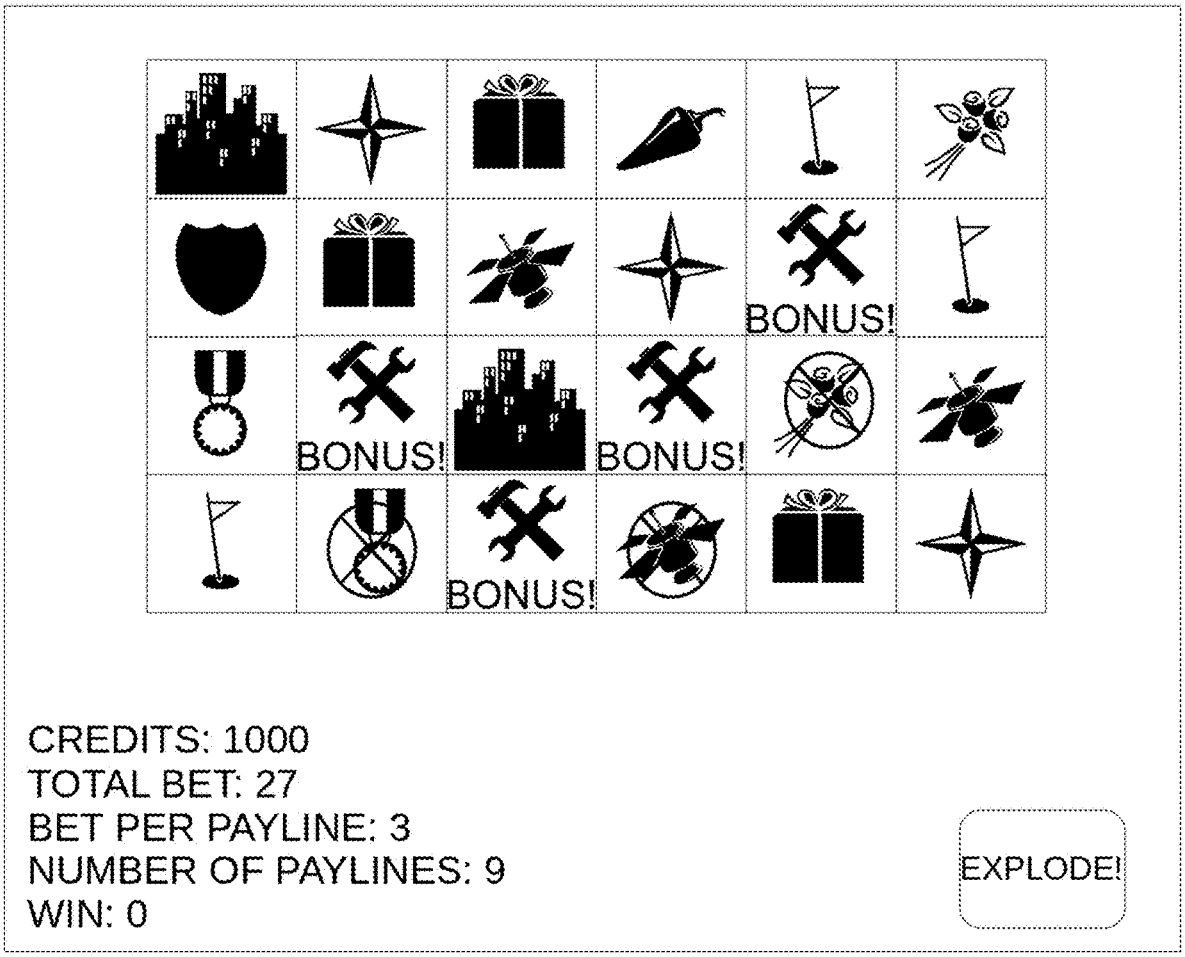
FIG. 8 is a drawing showing the example final result of the slot machine game with charges placed by the player, according to an embodiment.

FIG. 8 is a drawing showing the example final result of the slot machine game with charges placed by the player, according to an embodiment.

In operation 305, the player can place "charges" on any symbol(s) on the grid (being displayed) the player wishes. The charges will "blow up" a symbol, thereby causing all symbols above the charge to then "fall" down. Thus, the player should strategically place the charges so the player will achieve (after the charges are all exploded) the maximum number of horizontally adjacent bonus symbols (in the same row) in order to maximize the bonus award.

Note that typically as described herein, only the bonus symbols under the conditions described herein can be manipulated using the charges as described herein. However, in an alternate embodiment, instead of bonus symbols, other symbols used in a slot machine game could be subject to the same methods as described herein.

In one embodiment, the player will always have an unlimited number of charges to place. In another embodiment, the player will not have an unlimited number of charges and will have to earn charges by continuously playing the slot game. In the latter embodiment, for each spin, the player will earn a portion of a charge. For example, the player will earn a new charge every 10 spins. Each time the player starts a new playing session, the player will start with zero charges, and each time the player explodes a charge which he/she placed, a charge will be deducted from the player's current total amount of charges. As such, charges are accumulated by the player during game play, and will removed from the player's current total of charges when they are used. Note that a "persistent state" can be utilized, so that when the player logs out of the game, when the player returns the player will have the same number of charges as when he/she left the game last (in other words, the game picks up where the game has left off).

The player can use a GUI to place the charges (by selecting the symbol on the grid where the player wishes to place a charge and then pressing/clicking/touching a button to actually place the charge). The player can place as many charges as the player has (or an unlimited number of charges in the unlimited embodiment). The player can typically take his/her time placing charges and can also remove a placed charge if the player changes his/her mind regarding a placement. Ultimately, the player would have all of the charges placed in the player's desired locations, and then the player can press an "explode" button in order to explode all of the charges.

In FIG. 8, the player has placed three charges which are indicated by the circle with the 'X' in the middle. This player has not made the optimal play, as this will result in three bonus symbols falling to the very bottom row and thus there will be three horizontally adjacent bonus symbols. If the player had also placed a charge on the "present" symbol on the bottom row, then after the "explode" button is pressed the player would have four horizontally adjacent bonus symbols.

Figure 9:
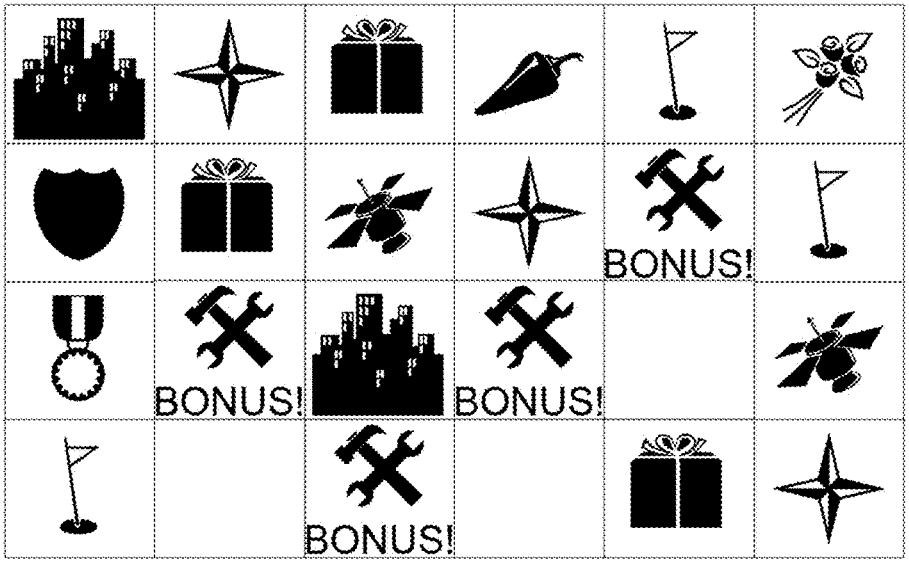
FIG. 9 is a drawing showing the example final result of the slot machine game with the symbols where the charges were placed destroyed (removed), according to an embodiment.

When the player presses the "explode!" button, then the charges will "explode" and the FIG. 9 will be displayed.

FIG. 9 is a drawing showing the example final result of the slot machine game with the symbols where the charges were placed destroyed (removed), according to an embodiment.

Note that all the symbols where the charges were placed have "exploded" (an appropriate explosion animation can be played for each charge) and disappeared (an "empty" symbol). FIG. 10 will then be initiated (displayed).

FIG. 10 is a drawing showing the symbols in each column dropped down to fill in any empty spaces, according to an embodiment.

All of the symbols above each of the empty symbols now drop down (using computer animation) to fill in all of the empty symbols. What results from this dropping animation is the grid illustrated in FIG. 10. There are three horizontally adjacent bonus symbols. Thus, the bonus award will be determined based on three horizontally adjacent bonus symbols. Note that the player has not played optimally. If the player had also placed a charge on the present in the bottom row, then there would be four horizontally adjacent bonus symbols, which would result in a bonus award algorithm with a higher expected value than the bonus award algorithm for three horizontally adjacent bonus symbols. The player is not given another chance to place additional charge(s) and the player is now stuck with his decisions.

Figure 11:
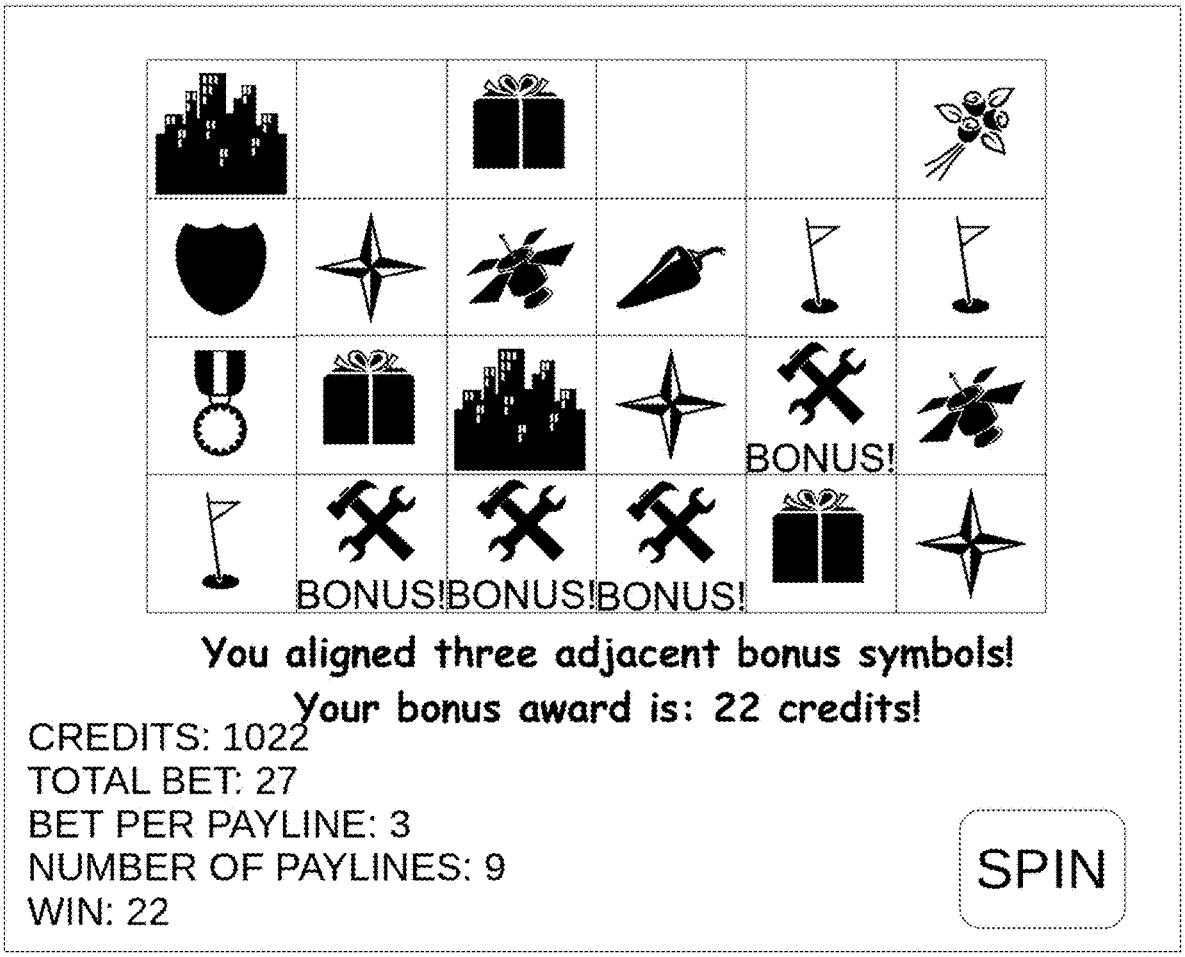
FIG. 11 is a drawing awarding of a bonus award based on a number of bonus symbols vertically aligned, according to an embodiment.

FIG. 11 is a drawing awarding of a bonus award based on a number of bonus symbols vertically aligned, according to an embodiment.

Because the bonus round resulted in three horizontally adjacent bonus symbols the bonus award algorithm (see Table I). for three horizontally adjacent bonus symbols is called (executed). This particular bonus award algorithm is a random number (inclusive) from 5 to 25. The computer randomly chooses the random number (in this range) of 22, which is the bonus award and is added to the credit meter.

Note that in an embodiment, the result of the bonus award algorithm can be multiplied by the wager per line (in the case that the player bets different amounts per line then the lowest wager per line can be used). This embodiment would result in a higher bonus award being awarded for higher wagers. In this example, if the player is betting 3 credits per payline, then the bonus award would be 66 (3 times 22) which would be added to the credit meter.

Note that in an embodiment (as discussed herein), the difference between the expected value of the optimal play and the actual bonus award (the player's error) would be added to a bonus pool. In this example, the optimal play would have resulted in four horizontally adjacent bonus symbols, which (from Table I) would have an expected value of 25. 25 minus 22 (the actual bonus award) equals 3, meaning that 3 (the "error") would be added to the bonus pool (which is awarded to the next player who plays the bonus round optimally). An optimal play of the bonus round means the player placed the charges in the right locations so that the highest number of horizontally adjacent bonus symbols would result. In the embodiment where the bonus award is multiplied by the wager per payline, then the expected value of the optimal play would be 75 (25*3) and the actual bonus award is 66 (22*3) with a different of 9, thus the bonus pool would be increased by 9.

In FIG. 11, pressing the "spin" button would then initiate a new slot game, meaning another 27 credits would be deducted from the credit meter (operation 300) and the reels would spin all over again (operation 301).

Note that the bonus game described herein is merely one example of a bonus round utilizing "error banking" described herein, but it can be appreciated that the error banking paradigm described herein can be applied to any other type of bonus round which utilizes skill of the player. For example, arcade style games such as a "brick breaker" game can be utilized for the skill portion carried out by the player, and otherwise the same concepts described herein can be applied (e.g., the player can play the skill game and if the player does not play optimally then the player's error can be added to a shared bonus pool, as described herein).

Figure 12:
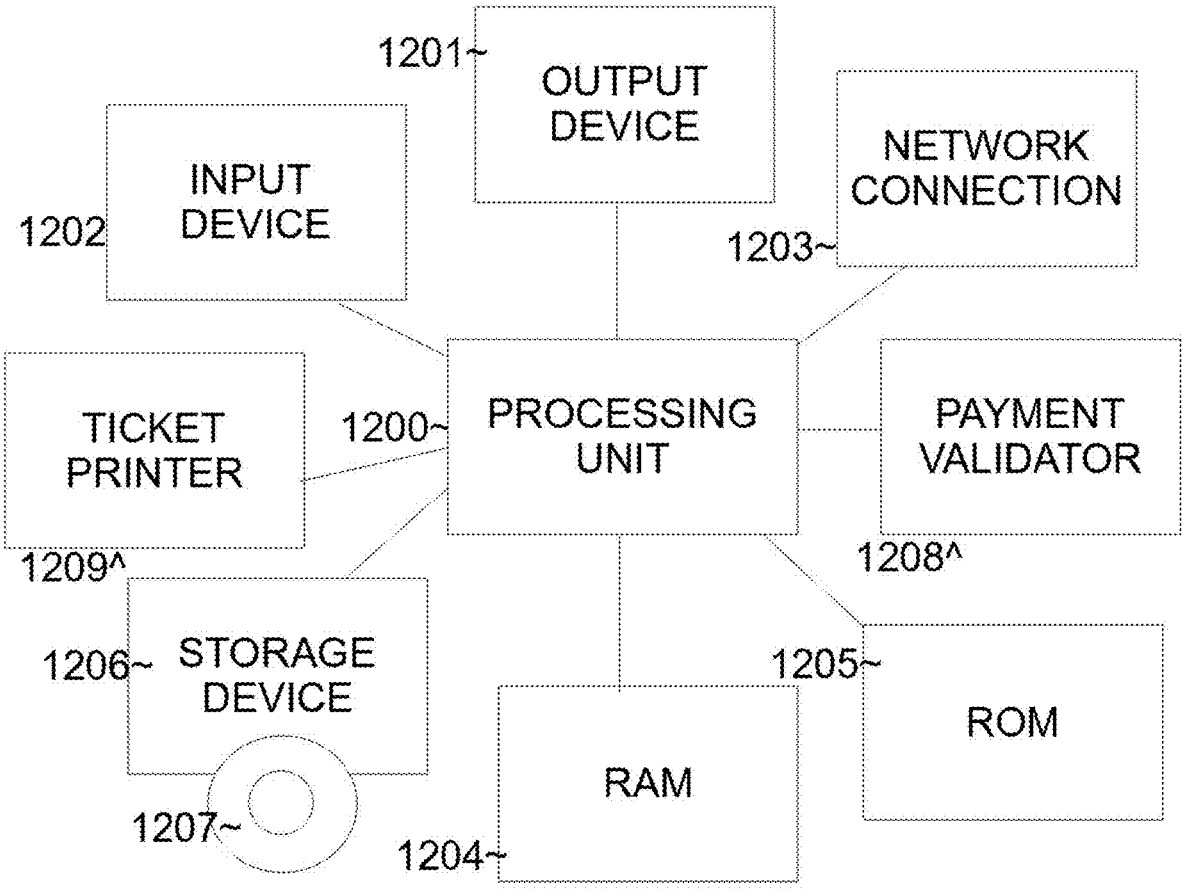
FIG. 12 is a block diagram illustrating exemplary hardware that can be used to implement the game described herein, according to an embodiment.

FIG. 12 is a block diagram illustrating exemplary hardware that can be used to implement the game described herein, according to an embodiment. The hardware in FIG. 12 can be used to implement a computer implementing the game described herein (e.g., implement an online casino utilizing real money wagers and payouts) and/or a server that is serving the game to a computer which is displaying the game to a player. Such a server can optionally interface with a social networking site (e.g., FACEBOOK, MYSPACE, etc.) that is used to coordinate the entire game and communicate with the players as well as a server used by the social network site. The hardware can also be, for example, an electronic gaming machine (EGM) used in casinos such as a video slot machine. The hardware can also be a server implementing an online casino which servers a large number (e.g., 1-1000 or more) of simultaneous remote players as well as a larger number of players who have an account with the online casino who many not be playing at a particular time. The hardware can also be a personal computer or personal computing device (e.g., laptop, desktop, cell phone, tablet, etc.) playing the game using the Internet. The hardware can also be any other type of device, working individually or in conjunction with other devices.

A processing unit 1200 (such as a microprocessor and any associated components) is connected to an output device 1201 (such as an LCD monitor, touch screen, CRT, etc.) which is used to display to the player any aspect/output/state of the method, and an input device 1202 (e.g., buttons, a touch screen, a keyboard, mouse, etc.) which can be used to input from the player any decision/input made by the player. All methods described herein can be performed by the processing unit 1200 by loading and executing respective instructions which are programmed accordingly. Multiple such processing units can also work in collaboration with each other (in a same or different physical location). The processing unit 1200 can also be connected to a network connection 1203, which can connect the electronic gaming device to a computer communications network such as the Internet, a LAN, WAN, etc. The processing unit 1200 is also connected to a RAM 1204 and a ROM 1205. The processing unit 1200 is also connected to a storage device 1206 which can be a disk drive, DVD-drive, CD-ROM drive, flash memory, etc. A non-transitory computer readable storage medium 1207 (e.g., hard disk, CD-ROM, solid state drive, or any other non-transitory medium which can store computer readable instructions), can store a computer readable program which (when executed) can control (and cause) the electronic device (and/or the processing unit 1200) to perform any and all of the methods described herein, and can be read by the storage device 1206 and written to by the storage device 1206.

The processing unit 1200 can also be connected to a payment validator 1208. The payment validator can be a bill acceptor which accepts currency, identifies it as being valid (typically by using an optical scanner), and then credits the inserted bill amount to the machine (for example inserting a $10 bill will credit the machine with $10 in credits). These credits can be used to play the games (e.g., pay for a spin). The bill acceptor can also accept cashless tickets as part of a 'ticket-in-ticket-out" system, in which tickets (cashless vouchers) have cash value and can be inserted into the payment validator 1208. The validator 1208 validates the ticket (typically be optically scanning a bar-code), communicating electronically with a casino database to verify the ticket is authentic, and once authenticated then crediting the machine with the respective amount of credits. The payment validator 1208 can also include a card reader which can read cards (e.g., with a magnetic stripe or other electronic encoding) so that an account number can be accessed. The cards can be a credit card, player loyalty card, specific casino payment card, or any card that can provide electronic access to a monetary amount owned by the player (owner of the card) which the player can utilize for depositing money and then playing the machine. If such a card is used, then the player can optionally enter (using a keypad) an amount the player wishes to withdraw from the account associated with the card to credit to the machine. The player can also the card in this matter to request that the machine electronically transfer any credits on the machine (e.g., credits) to the player's account associated with the card.

The processing unit 1200 can also be connected to a ticket printer 1209 which can print tickets (cashless vouchers). When the player cashes out on the machine (indicated to the machine that the player wishes to cash out and terminate by, typically by pressing a button), a ticket is printed by the ticket printer 1209 which carries (can be redeemed for) the amount of credits left on the machine in the credit meter. This ticket can then be used to play other machines in the casino by inserting them into that machine's payment validator. The ticket can also be used to redeem for cash by inserting it into a ticket redemption machine (kiosk) which receives a ticket, validates it (typically by scanning the barcode), and then dispenses an identical amount of cash to what the ticket's value is. Note that at any time during play, the player can cash out (typically by pressing a cash out button) all of the credits shown in the credit meter into numerous forms which are cash or can be redeemed by cash by the player, such as cash, coins, a cashless ticket, an electronic payment, crypto-currency, etc.

While one processing unit is shown, it can be appreciated that one or more such processor (processing units) can work together (either in a same physical location or in different locations) to combine to implement any of the methods described herein. Programs and/or data required to implement any of the methods/features described herein can all be stored on any non-transitory computer readable storage medium (volatile or non-volatile, such as CD-ROM, RAM, ROM, EPROM, microprocessor cache, etc.)

Note that if the embodiments described herein are implemented as an electronic gaming machine (EGM) then it may be necessary for the machine to be approved by the regulatory authorities (e.g., the Nevada State Gaming Commission) to ensure they have a suitable return to player (RTP) and are honest. Such approval includes inspection of the hardware, software, play-testing, evaluation of the random number generators (either hardware or software), etc. Once the machine has been approved from a rigorous testing will it be officially approved by a regulatory authority and then can appear in that jurisdiction's gaming floor.

Figure 13:
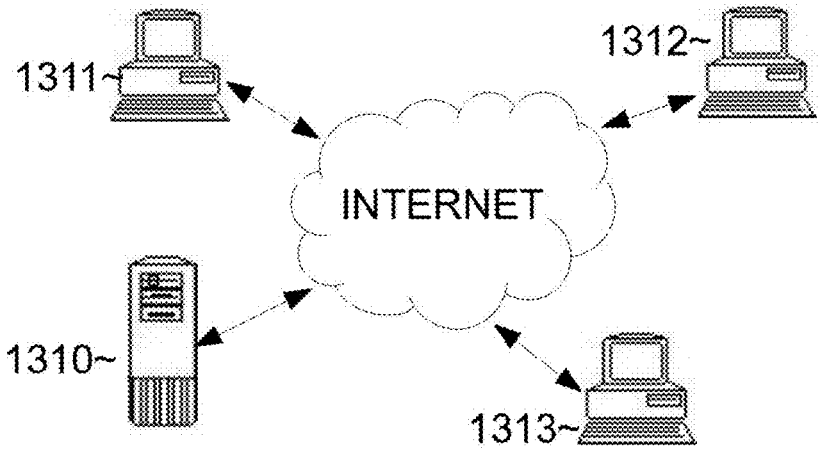
FIG. 13 is a network diagram showing a network structure for an online casino and players, according to an embodiment.

FIG. 13 is a network diagram showing a network structure for an online casino and players, according to an embodiment.

A computer communications network (such as the Internet) can be used to connect an online casino server 1310 which can host and serve an online casino and implement a game as described herein via the internet. Note that while FIG. 13 shows only one online casino server 1310, the casino server 1310 can encompass numerous servers all cooperating with each other (whether in the same physical location or not). The casino server 1310 communicates with players 1311, 1312, 1313 through the Internet (or other computer communication network) and can remotely implement any of the methods/games described herein by executing computer code programmed accordingly. As such, the methods/games described herein can be offered at an online casino for credits which are exchangeable for real money.

All components herein can be distributed across different such components as needed. For example, a single server as mentioned herein can be distributed across numerous different servers and locations. A processor (or processing unit) can also be distributed across multiple processors in a same or different computer (at a same or different location). The electronic components described herein represent an abstraction but it can be appreciated that the computer systems implementing the methods herein can be more numerous and interconnected than illustrated herein.

If a player is playing the game described herein on a social networking site or other type of hosted environment, then the player's computer would cooperate with the social networking server in order to present the game to the player. The player's computer would perform the instructions necessary to display the game while the remote server can determine the results (e.g., the final arrangement) and communicate this result via the Internet to the player's computer so that the player's computer can accurately display the result. The remote server may track and account for all credits wagered and won/lost while the player's computer can display the amount of credits owned or won at the direction of the remote server so the player cannot tamper with these amounts. All games described herein are considered to be played on the site described herein.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer. All variations and features described herein can be combined with any other features described herein without limitation. Note that "wager" and "bet" as used herein are generally synonymous with each other.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An apparatus to implement a game, the apparatus comprising:

an electronic output device and an electronic input device;

an electronic storage device configured to read a non-transitory computer readable storage medium which stores computer readable instructions;

at least one processing unit connected to the electronic output device, the electronic input device, and the electronic storage device, the at least one processing unit configured to utilize the electronic storage device to read and execute the computer readable instructions which are programmed to cause the at least one processing unit to:

receive a wager from a player;

spin reels and stop the reels on a final position;

determine whether a bonus round is triggered based on symbols in the final position;

if the bonus round is triggered, then perform:

receive decisions by the player and complete the bonus round, wherein the decisions involve skill of the player and affect the player's award in the bonus round;

determining whether the player's performance achieved a minimum goal;

if the minimum goal was not met, then the player receives no bonus award;

if the minimum goal was met, then the player receives a bonus award increased by an amount in a bonus pool shared by multiple players;

if the player did not play the bonus round optimally, then compute an error based on the player's performance and contribute the error to the bonus pool, wherein playing the bonus round optimally results in a most possible number of bonus symbols being horizontally adjacent.

2. The apparatus as recited in claim 1, wherein the computer readable instructions are programmed such that the error is computed as an expected value of an award algorithm corresponding to the player playing optimally minus the bonus award based on the player's decisions in the bonus round not including anything awarded from the bonus pool.

3. The apparatus as recited in claim 2, wherein the computer readable instructions are further programmed such that the error is multiplied by an amount of the wager.

4. The apparatus as recited in claim 1, wherein the computer readable instructions are further programmed such that the bonus round is triggered when there are at least a predetermined number of bonus symbols in adjacent reels in the final position, the predetermined number of bonus symbols being three.

5. The apparatus as recited in claim 1, wherein the computer readable instructions are further programmed such that the decisions by the player comprise a set of marked symbols in the final position.

6. The apparatus as recited in claim 5, wherein the computer readable instructions are further programmed to slide symbols above each symbol in the set of marked symbols downward to create a modified position thereby removing the set of marked symbols.

7. The apparatus as recited in claim 6, wherein the computer readable instructions are further programmed to determine a number of horizontally adjacent bonus symbols in the modified position, wherein the player played the bonus round optimally when the number of horizontally adjacent bonus symbols in the modified position is as high as possible considering the final position.

8. The apparatus as recited in claim 1, wherein the computer readable instructions are further programmed to award a number of free spins based on the player's decisions in the bonus round.

9. The apparatus as recited in claim 8, wherein the computer readable instructions are further programmed such that the bonus award is multiplied by an amount of the wager.

10. The apparatus as recited in claim 1, wherein the computer readable instructions are further programmed such that the player is playing the game at an online casino.

11. A method to implement a game, the method comprising:

providing an electronic output device and an electronic input device;

providing an electronic storage device configured to read a non-transitory computer readable storage medium which stores computer readable instructions;

providing at least one processing unit connected to the electronic output device, the electronic input device, and the electronic storage device;

executing the computer readable instructions by the at least one processing unit which cause the at least one processing unit to perform:

receiving a wager from a player;

spinning reels and stop the reels on a final position;

determining to trigger a bonus round based on symbols in the final position;

receiving decisions by the player and completing the bonus round, wherein the decisions involve skill of the player and affect the player's award in the bonus round;

implementing computer readable instructions that comprise both: a) awarding, only when the player's performance achieved a minimum goal, a bonus award to the player increased by an amount in a bonus pool shared by multiple players; and b) computing an error based on the player's performance and contributing the error to the bonus pool when the player did not play the bonus round optimally, wherein playing the bonus round optimally results in a most possible number of bonus symbols being horizontally adjacent; and repeating the receiving, spinning, determining, receiving, and implementing a plurality of times.

* * * * *